US008262408B1

(12) United States Patent
Kelly

(10) Patent No.: US 8,262,408 B1
(45) **Date of Patent: *Sep. 11, 2012**

(54) COAXIAL CABLE ASSEMBLY CONNECTION STRUCTURE AND METHOD

(75) Inventor: Mark A. Kelly, Endicott, NY (US)

(73) Assignee: Distinct Intuitive Designs, LLC, Endicott, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/288,782

(22) Filed: Oct. 22, 2008

(51) Int. Cl.
*H01R 9/05* (2006.01)

(52) U.S. Cl. ..... 439/578

(58) Field of Classification Search ..... 439/578, 439/447, 585, 580, 606, 730, 738, 607.45, 439/607.5, 607.51, 932, 464, 471; 174/89, 174/DIG. 8

See application file for complete search history.

(56) References Cited

U.S. PATENT DOCUMENTS

| | | | | | |
|---|---|---|---|---|---|
| 1,809,009 | A | * | 6/1931 | Andre | 439/795 |
| 2,125,555 | A | * | 8/1938 | Frantz | 439/598 |
| 2,279,866 | A | * | 4/1942 | Ellinwood | 174/40 CC |
| 2,786,095 | A | * | 3/1957 | Arbeiter | 174/88 C |
| 2,798,113 | A | * | 7/1957 | Koller et al. | 174/75 C |
| 3,235,619 | A | | 2/1966 | Cook et al. | |
| 3,395,244 | A | * | 7/1968 | Koehler | 174/135 |
| 3,502,788 | A | | 3/1970 | Albert | |
| 3,551,882 | A | * | 12/1970 | O'Keefe | 439/580 |
| 3,613,050 | A | * | 10/1971 | Andrews | 439/580 |
| 3,781,762 | A | * | 12/1973 | Quackenbush | 439/322 |
| 3,800,068 | A | * | 3/1974 | Torgerson | 174/135 |
| 4,010,538 | A | * | 3/1977 | O'Keefe et al. | 29/865 |
| 4,144,404 | A | | 3/1979 | DeGroef et al. | |
| 4,400,050 | A | * | 8/1983 | Hayward | 439/585 |
| 4,408,089 | A | * | 10/1983 | Nixon | 174/34 |
| 4,472,216 | A | * | 9/1984 | Hogenhout et al. | 156/50 |
| 4,553,806 | A | * | 11/1985 | Forney et al. | 439/277 |
| 4,703,989 | A | * | 11/1987 | Price et al. | 439/283 |
| 4,772,222 | A | * | 9/1988 | Laudig et al. | 439/578 |
| 5,141,451 | A | * | 8/1992 | Down | 439/585 |
| 5,238,419 | A | * | 8/1993 | Roeder et al. | 439/164 |
| 5,340,330 | A | * | 8/1994 | Dolson et al. | 439/447 |
| 5,490,803 | A | | 2/1996 | McMills et al. | |
| 2002/0039858 | A1 | * | 4/2002 | Kamel et al. | 439/521 |
| 2004/0110418 | A1 | * | 6/2004 | Holliday et al. | 439/585 |
| 2007/0155233 | A1 | * | 7/2007 | Laerke et al. | 439/578 |
| 2007/0270032 | A1 | * | 11/2007 | Eriksen | 439/578 |
| 2008/0032551 | A1 | * | 2/2008 | Burris et al. | 439/578 |
| 2008/0207051 | A1 | * | 8/2008 | Montena | 439/578 |
| 2009/0011637 | A1 | * | 1/2009 | Kim, II | 439/578 |

* cited by examiner

*Primary Examiner* — Renee Luebke
*Assistant Examiner* — Harshad Patel
(74) *Attorney, Agent, or Firm* — Mark Levy; David L. Banner; Hinman, Howard & Kattell, LLP

(57) ABSTRACT

A structure for the back end of repairable connectors, applicable for a variety of RF connectors, that facilitates superior mechanical and electrical characteristics of the resulting coax cable assembly. Also disclosed is a method of attaching one of various repairable connectors to coax cable that is both simple and stronger than existing methods. The outside insulation is removed from the end of the cable and the braiding is folded back out of the way. Depending on the number of layers of braiding, this step may be performed more than once. The dielectric surrounding the center conductor is then trimmed to expose the conductor. In one embodiment, a pin is soldered in-line with the center conductor. The connector is then placed on one end of the prepared cable and the braiding is unfolded. A band is then applied to secure the braiding against the connector, making a strong bond.

10 Claims, 7 Drawing Sheets

COAXIAL CABLE ASSEMBLY CONNECTION STRUCTURE AND METHOD

FIELD OF THE INVENTION

The invention relates generally to methods and structural features to enable attaching coaxial cable to connectors and, more specifically, to a specialized attachment structure and method that securely attaches a connector to a coaxial cable, and that achieves superior mechanical and electrical characteristics.

BACKGROUND OF THE INVENTION

Coaxial (coax) cable is nearly ubiquitous in today's technology-based, information-driven society. It is used in a wide variety of applications, including broadband Internet and cable television, as well as specialty applications, including a wide variety of radio frequency (RF) antennae applications.

Coaxial cable generally includes a central axial conductor element and one or more outer conductor elements wrapped concentrically around the central axial conductor. A low-loss, high dielectric insulation material separates the conductors. In most applications, an outer insulating cover is provided to shield the outer conductor element so as to provide insulations and physical protections to all inner components of the coaxial cable. The concentric conductor may be a single strand of conductive wire that is wrapped helically around the insulating material that covers the central, axial conductor element, or more typically, a fine wire braid or mesh fashioned from conductive materials such as copper, aluminum and aluminum alloys, stainless steel, metallized polymer materials, and the like.

Throughout all sectors of the economy, and throughout all facets of the consumer, mass-market culture, coaxial cable has penetrated virtually every crevice of infrastructure to deliver broadband Internet connections or wide band radio frequency information for computers, radios and television. Increasingly, coaxial cable networks are the preferred medium for a majority of citizens who wish to access news, entertainment and information, as well as perform myriad daily tasks such as shopping, paying bills, communicating with family, friends and business contacts.

Because modern society is so dependent on information connections via coaxial cable networks, it is important that these networks be dependable and reliable, as well as adaptable for expansions and modifications, or repairs when storms, fires or other events damage them. Whenever these expansions, modifications or repairs are required, it is always necessary to join, or splice, the terminal ends of separate, coaxial cables. Sometimes, hundreds or even thousand of splices are required to meet the demands of a particular upgrade or repair. Under any circumstance, the splicing of coaxial cable termini is labor intensive. Moreover, because of the delicate and fragile characteristics of certain aspects of coaxial cable design, the splicing requires a specific skill set.

Coaxial cable generally includes a central axial conductor element and an outer conductor element wrapped concentrically around the central element. A low-loss, high dielectric insulation material separates the two conductors. In most applications, an outer insulating cover is provided to shield the outer conductor element so as to provide insulation and physical protection to all inner components of the coaxial cable. The concentric conductor may be a single strand of conductive wire that is wrapped helically around the insulating material that covers the central, axial conductor element, or, more typically, a fine wire braid or mesh fashioned from an aluminum alloy.

In order for coaxial cable to function properly, it is critical that the insulation between the two conductive elements be maintained, and that the isolation distance separating the two conductive elements be constant. This controlled insulation and separation allows the outer conductive element to serve as a shield to protect the inner conductive element from electromagnetic, or radio frequency interference (RFI). If the inner conductive element is not properly shielded from RFI, the communication signals transported along the inner conductive element will be degraded, modulated with undesirable changes, or completely interrupted.

When the connections along a length of coaxial cable are properly made, the cable is essentially shielded from interference of RFI. This shielding is made possible because the outer conductive element carries a current that is precisely the reverse of the inner conductive element, thereby creating a pair of magnetic fields that cancel each other out. However, if the termini of the outer conductive elements are not precisely and uniformly connected so as to maintain the aforementioned insulation and separation parameters, little or no reverse current will flow along the outer element and the shielding will collapse. Without proper shielding, the signal current traveling along the inner conductive element will emit electromagnetic radiation to the atmosphere. At the same time, extraneous electromagnetic radiation from the atmosphere will be absorbed by the inner conductive element.

Some applications for coaxial cable installations need the benefit of improved mechanical and electrical characteristics. Certain applications either require, or benefit substantially from, a capability to withstand mechanical pull strength between the cable and connector that meets or exceeds a specified pull force. This characteristic is known as high pull strength, and allows the cable to be pulled through wire channels and special installations, without causing damage to the cable or to the electrical connection between the cable and the connector.

Additionally, some applications require an extremely low loss electrical characteristic. Power loss, or attenuations, occurs whenever power is transmitted within a cable, and is usually identified in decibels per unit length of cable. Attenuation can be caused by resistive heating of the conductors within the cable, dielectric loss, and radiated loss from power dissipated from the cable into the surroundings. In general, attenuations increase with frequency, and is dependent on a number of factors, including the size and type of conductors, the dielectric material in the cable, the propensity of the dielectric material to absorb moisture, and the type and quality of the shielding.

DISCUSSION OF RELATED ART

As example, U.S. Pat. No. 3,502,788 to Albert for ELECTRICAL CONNECTORS FOR COAXIAL CABLES shows a connector for coaxial cables having an inner tube through which the center conductors are inserted and connected. The tube may have solder wells for solder connecting the inner conductor. The outer conductors of the coaxial cables are connected via an outer rigid cylinder terminating in a flanged portion that contacts the inner surface of the outer conductor by positioning the spliced cable over the flange so it is interposed between the inner insulation covering the inner conductor, and the outer conductor. Electrical contact is obtained by placing a heat-shrinkable plastic member over a ferrule, which is in contact with the outer cable insulation to cause the outer conductor upon heating to be compressed inwardly against the flange. Such a configuration suffers from the disadvantage that electrical contact is dependent entirely on the pressure exerted by the heat-shrinkable member due to the non-deformability of the flange. In addition, the flange must be of precise dimension as to be inserted between the outer conductor and the inner insulation. Additionally, this structure does not provide for a high pull strength cable assembly.

U.S. Pat. No. 3,235,619 to Cook et al. for HEAT RECOVERABLE REINFORCED ARTICLE AND PROCESS discloses a conductor in which a deformable, metallic braid is interposed between an inner tube and an outer jacket. The jacket and tube may be heat-deformable and serve as inner and outer insulation for coaxial cables. It has been suggested that such a braid may serve as the electrically conductive shield for coaxial cable and mention is made of its use in caps, splices and closures. Nonetheless, there is no teaching of how the braid is used to interconnect coaxial cable with a non-deformable shell or solder impregnation.

U.S. Pat. No. 4,144,404 to De Groef et al. for COAXIAL CABLE CONNECTOR AND METHOD OF MAKING A COAXIAL CABLE CONNECTION shows a connector and method of connecting electrical conductors or other substrates. The connector is a shell comprising a hollow heat-recoverable member having two open ends, an electrically conductive deformable member disposed within the heat recoverable member, and a quantity of solder also disposed within the heat-recoverable member. Solder is also disposed within the heat-recoverable member. To make a connection, the conductors are inserted into different ends of the sleeve and the assembly heated to cause recovery of the heat-recoverable member. The recovery force of the recoverable member deforms the deformable member into close contact with the conductors to provide mechanical strength to the connection and electrical contact between the conductors. The heat used to bring about recovery also fuses the solder to improve both the mechanical and electrical integrity of the connection.

U.S. Pat. No. 5,490,803 to McMills et al. for COAXIAL CABLE CONNECTION METHOD AND DEVICE USING OXIDE INHIBITING SEALANT discloses a method and device for the connection of coaxial cable termini to one another. The method comprises the removal of metal oxides from the concentric conductor portions of the two cable termini, applying a sealant to the concentric conductor portions, applying a sealant to the concentric conductor termini and then connecting the central conductor termini to one another and the concentric conductor termini to one another. The device includes a collet structure dimensioned to slip over the outside of a standard connection jack. Within the collet structure is disposed a quantity of sealant. The collet structure has at least one aperture through which sealant oozes from the collet structure to the exterior thereof. When the collet structure is attached to the jack, the sealant oozes onto the concentric conductor, thereby sealing the concentric conductor.

All the above-mentioned patents suffer the disadvantage that they do not allow for the splicing of plural layers of insulation and outer conductive elements. This disadvantage renders these patents substantially obsolete for a late generation of coaxial cable that retains plural layers of conductive elements and insulation. As shown below herein, the present method provides means whereby plural layers of conductive elements and insulation can be securely and effectively terminated to a desired connector.

A method of producing high pull strength coax cable assemblies currently practiced in the industry involves fixing the cable and connector in place using epoxy. This method suffers from the disadvantages that a curing process may be required; the completed assembly is not repairable.

It is therefore an object of the invention to allow coax cable termination to a connector to be accomplished in an enhanced way.

It is another object of the invention to provide enhanced connector features that facilitate the termination of a coax cable to the connector in an enhanced way.

It is another object of the invention to provide stronger and longer lasting connector terminations.

It is another object of the invention to provide a coaxial cable assembly with improved signal attenuation characteristics.

It is yet another object of the invention to enable those not immersed in the art to achieve similar results.

It is a further object of the invention to provide the capability to repair or replace coaxial cable termination to a connector using a band installable without a tool at any location where the cable assembly is used.

SUMMARY OF THE INVENTION

The inventive method provides a series of actions that, when performed in serial chronology, allow for a plurality of layers of substrate that wrap around and provide RFI shielding for the inner conductive element to be effectively terminated to an appropriately designed connector with the disclosed connector features. The appropriately designed connector provides the needed surfaces on the back end of the connector to allow for proper, effective attachment of the shield layers, as well as appropriately designed threads and/or mating teeth to accommodate a backshell adapter, facilitating both mechanical and electrical benefits. Additionally, the method allows technicians to make effective, high quality terminations to connectors that have exceptional tensile strength. Moreover, these terminations can be achieved by using one industry standard tool: a banding tool; although a preferred embodiment can be utilized with no banding tool. The intent of this system is to facilitate manufacturing and repair of coax cable assemblies with high pull strength and low attenuation loss characteristics of the coax cable assembly. The use of the band provides for uniform, 360° circumference contact between the shield and the connector body.

The invention has two interrelated aspects, as follows: a high pull strength cable assembly including a coaxial cable and a connector, with a back end designed for accepting the free end of a coaxial cable. The connector back end incorporates a flat region to accommodate attachment of a concentric braided shield from the coaxial cable. A lip is also provided at the edge of the flat region to retain the braided shield and flexible metal band. Optionally, another connector can be provided to accommodate a threaded backshell adapter, not typically used with RF connectors, that facilitates the additional attachment of a second concentric braided shield.

The second portion of the invention is a method for attaching a connector to a free end of a coaxial cable. A portion of a layer of insulation is first removed from a free end of a coax cable. A layer of braiding is then retracted from the coax cable by folding back the layer of braiding. Dielectric is trimmed around the center conductor of the coax cable to a distance less than that of the braid layer retraction. A connector is applied to the free end of the coax cable. The layer of braiding is unfolded to cover a portion of the connector. The layer of braiding and the portion of said connector are overlaid with a band to mechanically and electrically attach the layer of braiding to the connector.

Optionally, a second layer of braiding can be folded back and the banding can be overlaid to another portion of the connector body. A pin can be soldered on the center connector of the coaxial cable. The connector is chosen from the group: BNC, Type N, Type F, Type C, MUSA, SMA, TNC, and other RF connectors.

BRIEF DESCRIPTION OF THE DRAWINGS

A complete understanding of the present invention may be obtained by reference to the accompanying drawings, when considered in conjunction with the subsequent detailed description, in which.

DESCRIPTION OF THE PREFERRED EMBODIMENT

Generally speaking, the present invention features a novel connector back end, and a method of terminating a coax cable to a connector, that facilitates the manufacturing of a field repairable, high pull strength, electrically superior cable assembly. The method includes the steps of covering a portion of the cable with an unfolded layer of braiding and employing a band to the braiding and connector. Previous methods of coax terminations were limited in strength of connector junction due to styling that placed the bulk of bending, tension, and compression stresses on the outer jacket insulation, and by compression proximity, the inner layers of the cable. This allowed slippage of the connector under the crimp, overcoming the stiction of the crimped cable, thereby weakening the connector and allowing ingress of unwanted signal attenuation or outright disruption.

For ease of understanding described embodiment, like reference numbers are used throughout the figures to callout same items figure to figure.

Figure 1:
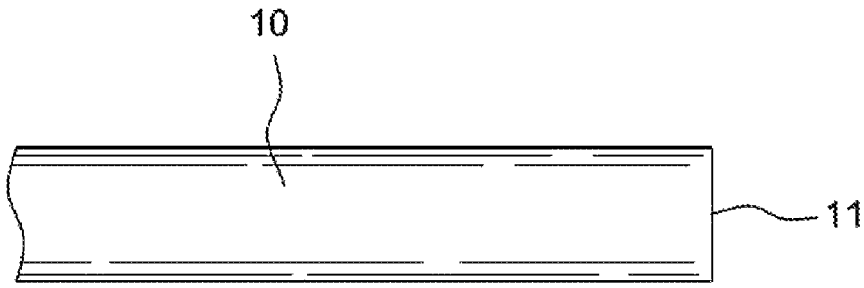
FIG. 1 is a front plan view of a coax cable in accordance with the invention.

Referring now to FIG. 1 there is shown a front plan view of a coax cable 10 having a raw cut end 11 prior to work being done. The outer layers of insulation are intact in this view.

Figure 2:
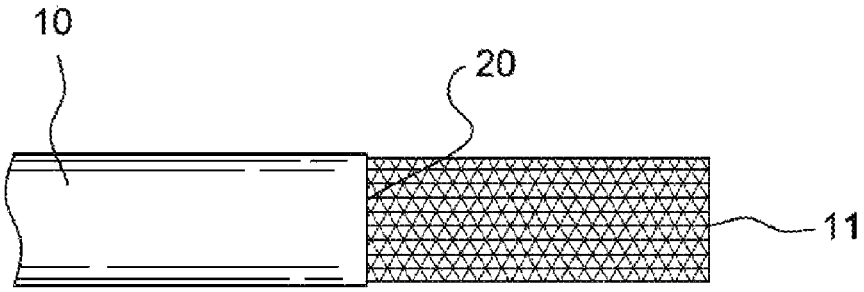
FIG. 2 is a front plan view of a coax cable with insulation removed.

FIG. 2 is a front plan view of a coax cable 10 with insulation 20 removed using tools known in the trade.

Figure 3:
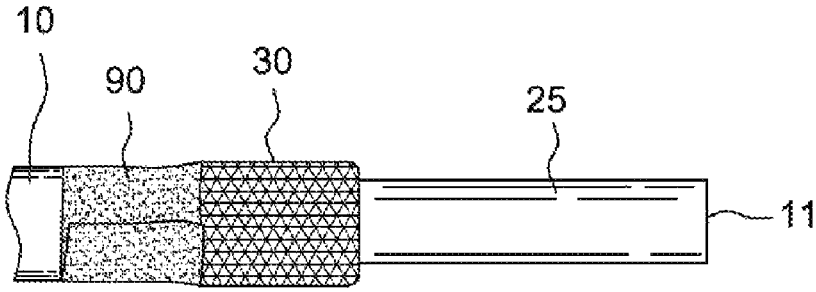
FIG. 3 is a front plan view of a coax cable with braiding pulled back.

FIG. 3 is a front plan view of a coax cable with braiding 30 pulled back and adhesive tape 90 applied to keep braiding out of the way, so it does not get disordered, and exposing a second layer of insulation 25.

Figure 4:
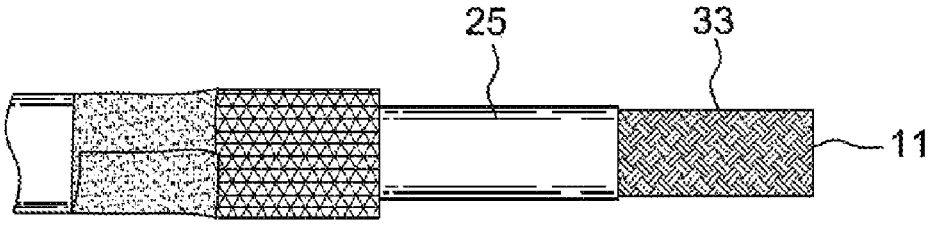
FIG. 4 is a front plan view of a coax cable with the second layer of insulation removed.

FIG. 4 is a front plan view of a coax cable with second layer of insulation 25 removed exposing a second layer of braiding 33.

Figure 5:
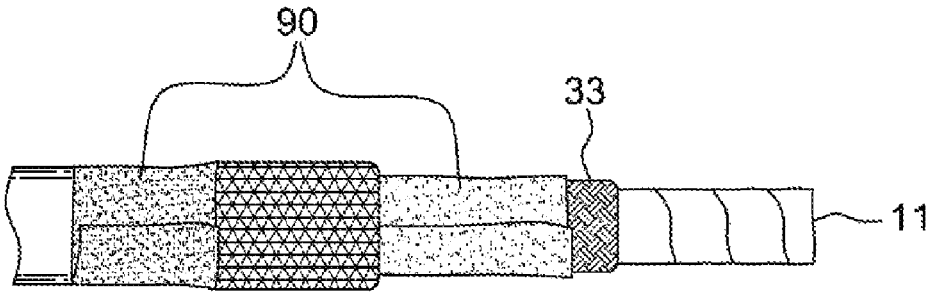
FIG. 5 is a front plan view of a coax cable with the second layer of braiding retracted.

FIG. 5 is a front plan view of a coax cable with second layer of braiding 33 retracted and held in place using adhesive tape 90.

Figure 6:
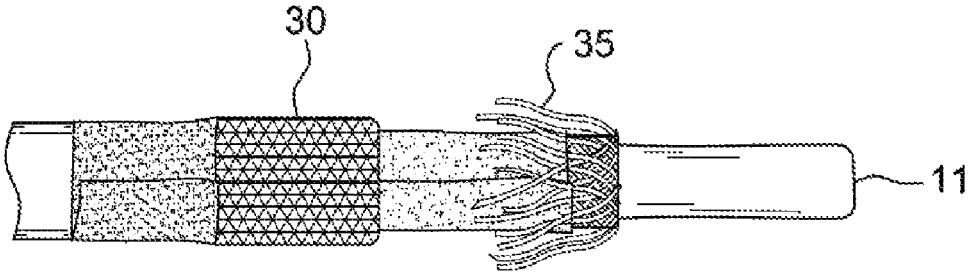
FIG. 6 is a front plan view of a coax cable with the third layer of braiding retracted.

FIG. 6 is a front plan view of a coax cable with second layer of insulation 25 removed and with third layer of braiding 35 retracted.

Figure 7:
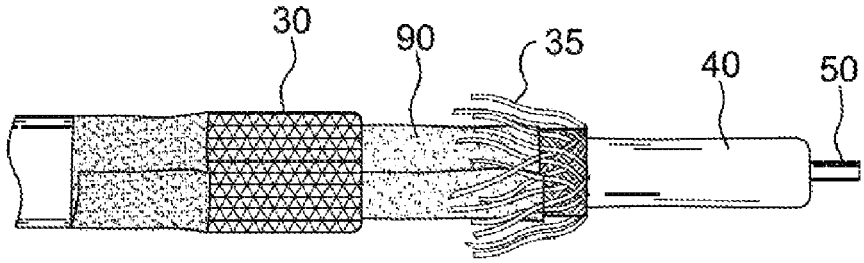
FIG. 7 is a front plan view of a coax cable with the center conductor dielectric removed, exposing the center conductor.

FIG. 7 is a front plan view of a coax cable with center conductor dielectric 40 removed, exposing center conductor 50.

Figure 8:
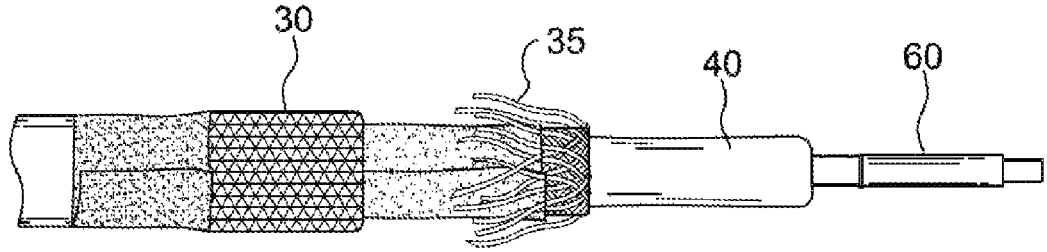
FIG. 8 is a front plan view of a coax cable showing a center pin conductor soldered in place.

FIG. 8 is a front plan view of a coax cable showing a center pin conductor 60 soldered in place. This embodiment may or may not be employed depending on connector type selected. For example, center pin conductor 60, if not stranded, can be pointed and forced into the connector body without the use of solder. Moreover, a hyperboloid socket can also be used.

The inventive method incorporates the use of one primary component, other than the coax cable: the band that is unique to this implementation of a coaxial cable connection method. Band 80 (FIGS. 11, 13-15) comprises a flexible material which may be any one of, but not limited to: metallic, composite, plastic, polymeric and shrink solder. In the preferred embodiment, band 80 is metallic. When a spring band is used, no installation tool is required.

Figure 9:
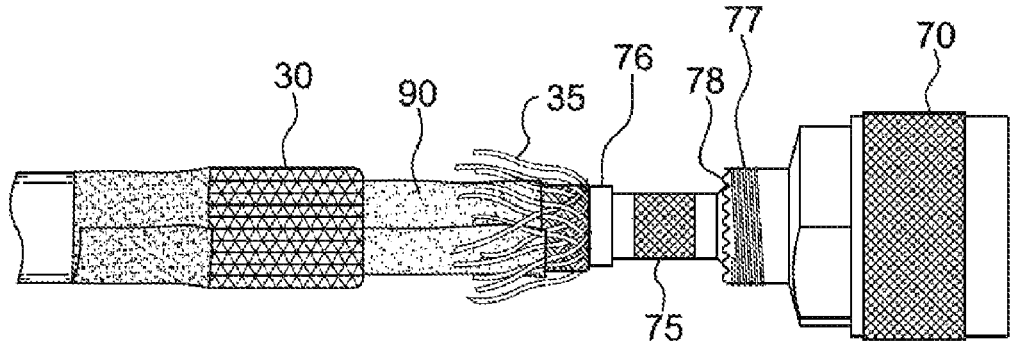
FIG. 9 is a front plan view of a coax cable showing a type N connector in place on the prepared end of coax cable.

FIG. 9 is a front plan view of a coax cable showing a gold-plated Type N connector 70 in place on prepared end of coax cable. In the preferred embodiment, a tri-metal plating finish is used. This view also shows the novel aspects of the connector back end, including the braid band land area 75, the retaining lip 76 at the end of the braid band land area 75, the threaded section 77 and the mating teeth 78 to accommodate a backshell adapter, which is typically not used in combination with an RF connector.

Figure 10:
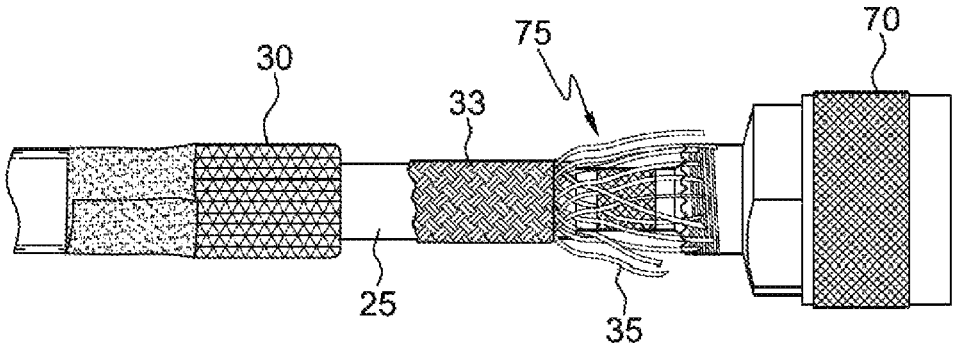
FIG. 10 is a front plan view of a coax cable showing the braiding un-retracted and placed over the connector braid band land area.

FIG. 10 is a front plan view of a coax cable showing braiding 33 un-retracted and placed over braid band land area 75 of Type N connection 70 with second retracted braiding adhesive tape removed. These figures portray a Type N connector as one embodiment. This constraining structure is provided only to aid those not versed with the fine art of cable termination.

Figure 11:
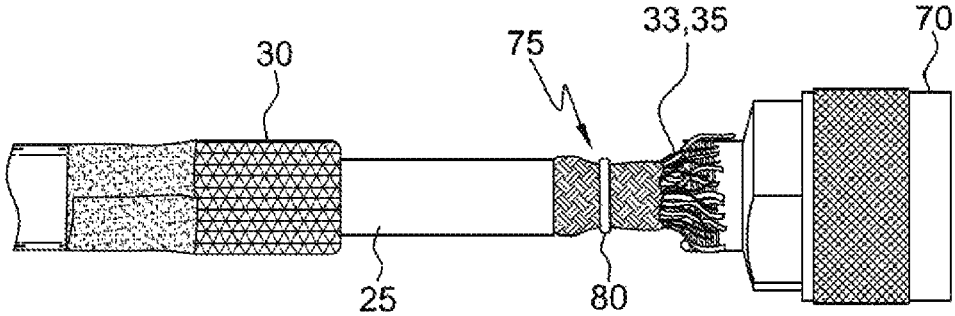
FIG. 11 is a front plan view of a coax cable showing the second braid un-retracted and a metal band placed over the two layers of braids.

FIG. 11 is a front plan view of a coax cable showing second braid 33 un-retracted and a flexible metal band 80 placed over the two layers of braids 33, 35 in the flat braid band land area 75. The metal band 80 has inherent shape retention of the material employed in its production. An alternate embodiment involves sliding the innermost braid into the connector.

Figure 12:
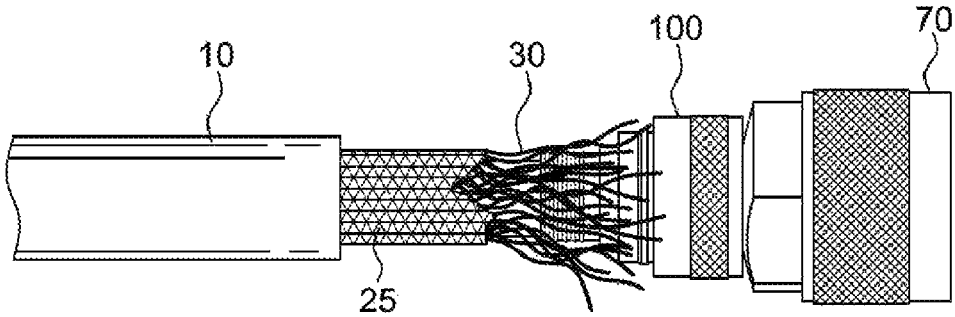
FIG. 12 is a front plan view of a coax cable showing the connector back shell in place and the last layer of braiding un-retracted and in place for metal band.

FIG. 12 is a front plan view of a coax cable showing connector back shell 100 in place and last layer of braiding 30 un-retracted and in place for application of flexible metal band 80 (FIG. 11). Connector back shell 100 is shown as a straight component, but the invention is not limited thereby; back shall 100 may also be bent.

Figure 13:
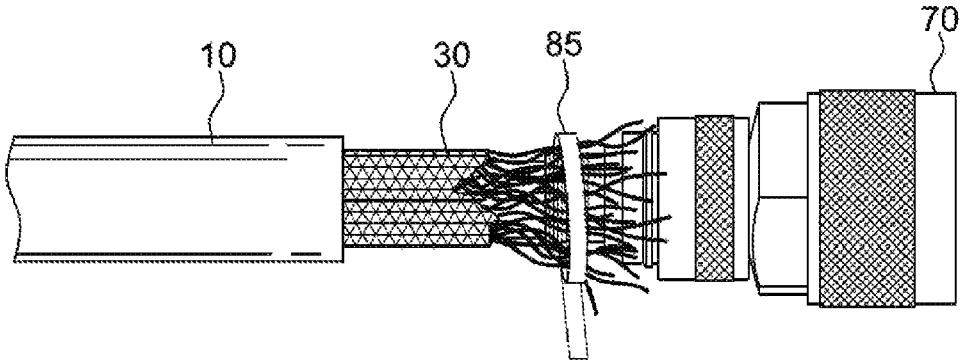
FIG. 13 is a front plan view of a coax cable showing a metal band in position, prior to cinching.

FIG. 13 is a front plan view of a coax cable showing a larger, flexible metal band 85 in position, prior to cinching. By ensuring that the layer of braiding 30 is pulled taught toward the connector back shell 100 prior to cinching the flexible metal band 85, this step provides sufficient strain relief to produce a cable assembly with superior pull strength characteristics. Pull strength is additionally facilitated by the use of a low weave angle braid, including but not limited to stainless steel, Kevlar, composites, etc.

Figure 14:
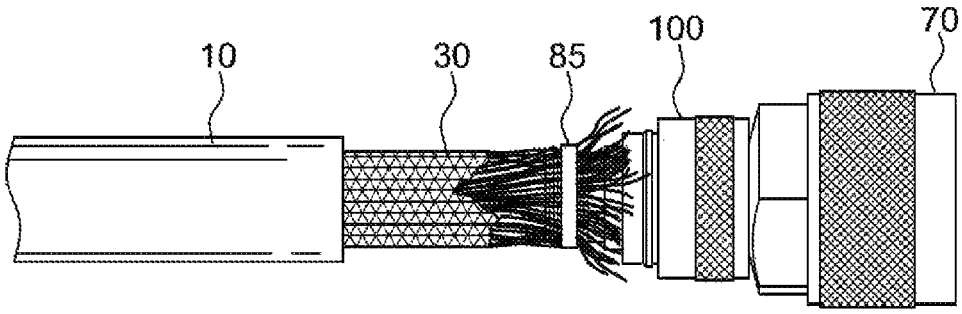
FIG. 14 is a front plan view of a coax cable showing the metal band, post cinching.

FIG. 14 is a front plan view of a coax cable showing flexible metal band 85, post cinching.

Figure 15:
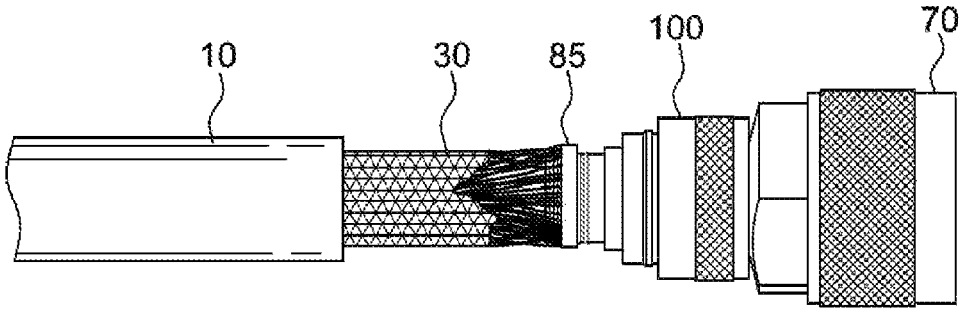
FIG. 15 is a front plan view of a coax cable showing the braiding trimmed.

FIG. 15 is a front plan view of a coax cable showing braiding 30 trimmed adjacent to flexible metal band 85.

Figure 16:
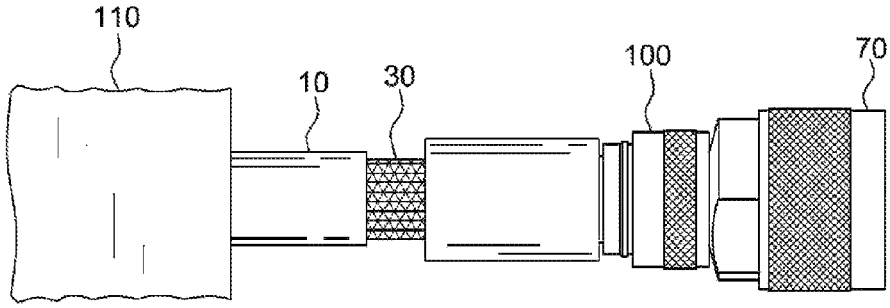
FIG. 16 is a front plan view of a coax cable showing adhesive tape in place.

FIG. 16 is a front plan view of a coax cable showing adhesive tape 90 in place prior to application of convoluted shrink boot, not shown, which may be blow molded, injection molded and/or convoluted and at any shaped angle.

Figure 17:
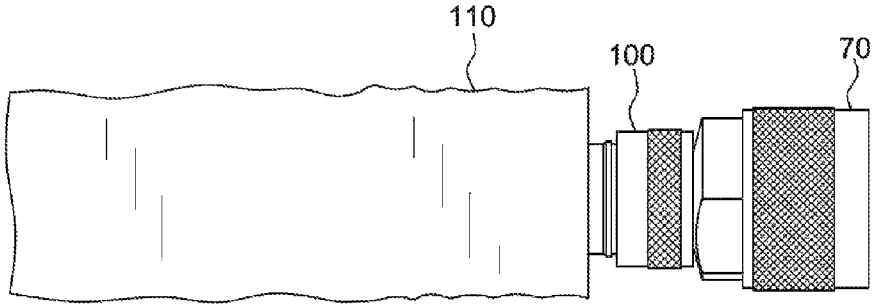
FIG. 17 is a front plan view of a coax cable showing shrink boot in place.

FIG. 17 is a front plan view of a coax cable showing convoluted shrink boot 110 attached at one end, prior to final heat application.

Figure 18:
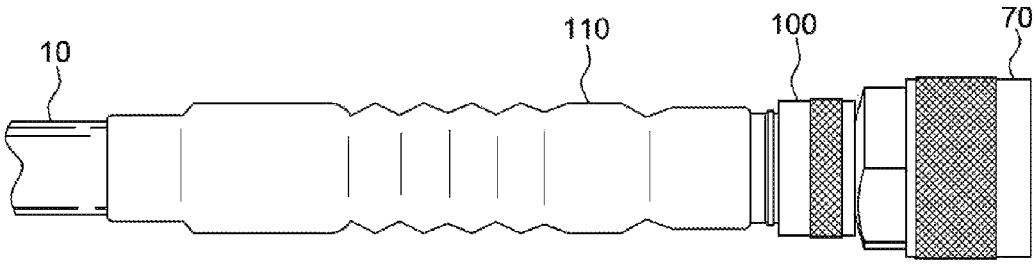
FIG. 18 is a front plan view of a coax cable showing convoluted shrink boot in place.

FIG. 18 is a front plan view of a coax cable 10 showing convoluted shrink tubing 110 in place.

Figure 19:
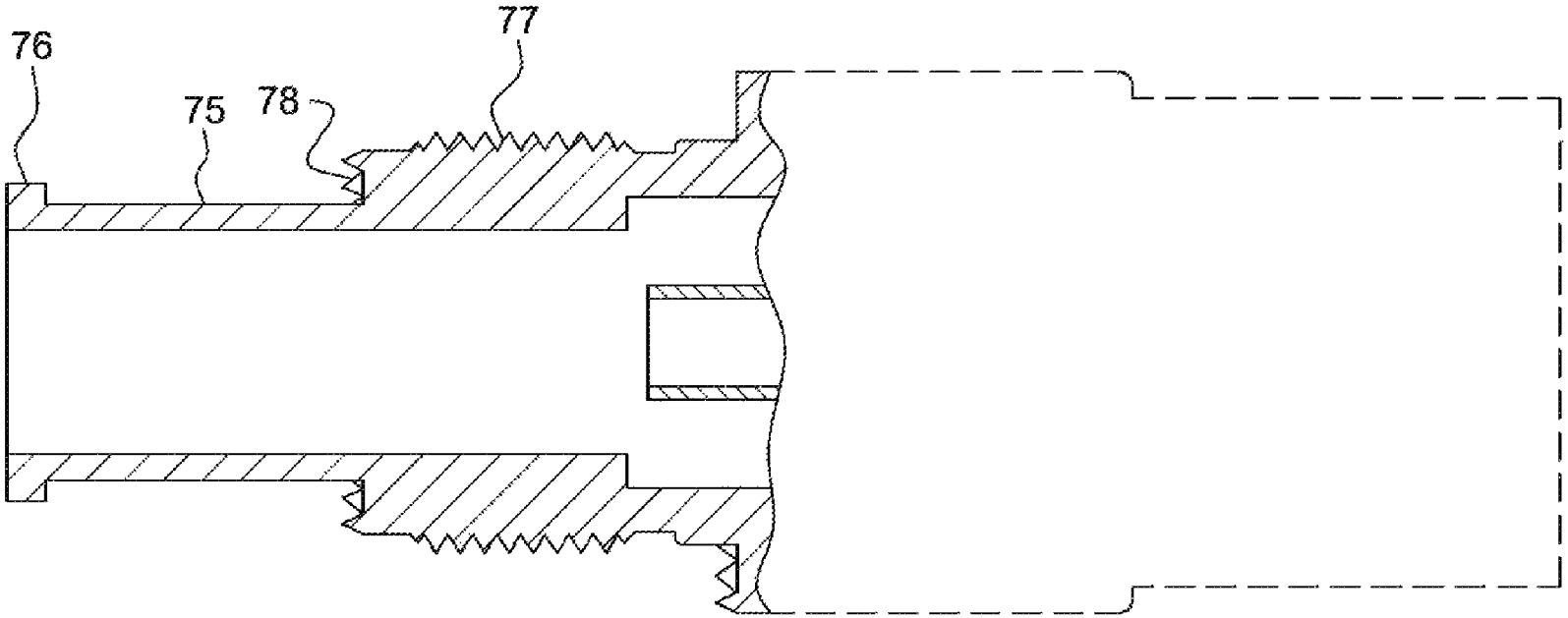
FIG. 19 is a cross-sectional view of a Type N connector showing the cable termination features in accordance with the invention.

FIG. 19 is a cross-sectional view of a type N connector 70 showing in cross-section a braid band land area 75 and a retaining lip 76 to facilitate termination of said coax cable 10 (FIG. 1), and a threaded section 77 and mating teeth 78 to accommodate said backshell adapter 100 (FIGS. 14-18).

What has been described is a repairable cable assembly having high pull strength (over 150 lbs) for use with coaxial cables.

Since other modifications and changes varied to fit particular operating requirements and environments will be apparent to those skilled in the art, the invention is not considered limited to the examples chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. A connector for attachment to a coaxial cable to form a repairable cable assembly, the connector comprising:

a front coupler portion adapted for electrical and mechanical interconnection with an external device, rotatively connected to a rear connector portion for receiving and both electrically and mechanically connecting to a free end of a coaxial cable, said rear connector portion comprising:

i) a hollow, elongated barrel rotatively connected to, concentric with, and extending rearwardly from a rear edge of said front coupler portion, said hollow, elongated barrel comprising:

aa) a forward hollow barrel portion having a first proximal end, a first distal end, and a first diameter, said first proximal end being connected to said front coupler portion at a rear edge thereof, said forward barrel portion being concentric with said front coupler portion and having external threads circumferentially disposed on at least a portion of an external surface thereof, and teeth disposed axially on a distal end surface thereof, said distal end surface being substantially perpendicular to said thread-bearing external surface; and bb) a rear barrel portion having a second proximal end, a second distal end, and a second diameter, said second diameter being smaller than said first diameter, said second proximal end being disposed adjacent said first distal end, said rear barrel portion being concentrically connected to said forward barrel portion, said rear barrel portion having a knurled pattern circumferentially disposed on at least a portion of an external surface, said knurled surface forming a braid band land area, and a raised, concentric lip disposed proximate said second distal end of said rear barrel portion, said raised concentric lip having an outside diameter larger than said second diameter to prevent rearward movement of a braid restraining apparatus surrounding said braid band land area; and ii) a hollow connector back shell comprising axially disposed teeth for mechanical engagement with said teeth disposed axially on said distal end surface of said forward barrel portion, whereby said hollow connector back shell may be secured at a desired axial position relative to said forward barrel portion, said hollow connector back shell being removably engaged with said external threads of said inner connector portion.

2. The connector for attachment to a coaxial cable to form a repairable cable assembly in accordance with claim 1, wherein said rear connector portion for connecting to a coaxial cable comprises features adapted to independently receive and retain at least two braided shield layers separated from one another by an insulating material.

3. A high pull strength, repairable cable assembly, comprising:

a) a connector in accordance with claim 2; and b) a coaxial cable comprising at least two braided shield layers separated from one another by an insulating material and both electrically and mechanically connected thereto.

4. The connector for attachment to a coaxial cable to form a repairable cable assembly in accordance with claim 1, wherein said hollow connector back shell comprises internal threads sized and configured for threaded engagement with said external threads of said forward barrel portion, whereby said hollow connector back shell may be selectively removed from and reinstalled to said rear connector portion to facilitate repair of said repairable cable assembly.

5. A high pull strength, repairable cable assembly, comprising:

a) a connector in accordance with claim 4; and b) a coaxial cable comprising at least two braided shield layers separated from one another by an insulating material and both electrically and mechanically connected thereto.

6. The connector for attachment to a coaxial cable to form a repairable cable assembly in accordance with claim 1, wherein said braid restraining apparatus surrounding said braid band comprises a flexible band removably and completely encircling at least a portion of said braid band land area of said second barrel portion, and is formed from at least one of the materials selected from the group: metal, polymer, Kevlar, plastic, shrink solder, and composites.

7. The connector for attachment to a coaxial cable to form a repairable cable assembly in accordance with claim 6, wherein said flexible band comprises a spring band.

8. A high pull strength, repairable cable assembly, comprising:

a) a connector in accordance with claim 7; and b) a coaxial cable comprising at least two braided shield layers separated from one another by an insulating material and both electrically and mechanically connected thereto.

9. A high pull strength, repairable cable assembly, comprising:

a) a connector in accordance with claim 6; and b) a coaxial cable comprising at least two braided shield layers separated from one another by an insulating material and both electrically and mechanically connected thereto.

10. A high pull strength, repairable cable assembly, comprising:

a) a connector in accordance with claim 1; and b) a coaxial cable comprising at least two braided shield layers separated from one another by an insulating material and both electrically and mechanically connected thereto.

* * * * *